US006443601B1

(12) United States Patent
Wu

(10) Patent No.: US 6,443,601 B1
(45) Date of Patent: Sep. 3, 2002

(54) RAPID ASSEMBLY AND DISASSEMBLY LAMP SHADE STRUCTURE

(76) Inventor: Wen-Chang Wu, No.10,Lane 191, Hsi Hsin Street, Chang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/838,107

(22) Filed: Apr. 20, 2001

(51) Int. Cl.[7] ..... F21V 1/06
(52) U.S. Cl. ..... 362/352; 362/434; 362/450
(58) Field of Search ..... 362/352, 356, 362/358, 434, 450, 360, 315

(56) References Cited

U.S. PATENT DOCUMENTS 4,354,222 A * 10/1982 Gall ..... 362/352
5,375,048 A * 12/1994 Barnes ..... 362/352
6,315,434 B1 * 11/2001 Long ..... 362/352

* cited by examiner

*Primary Examiner*—Sandra O'Shea
*Assistant Examiner*—John Anthony Ward

(74) *Attorney, Agent, or Firm*—Troxell Law Office PLLC

(57) ABSTRACT

A rapid assembly and disassembly lamp shade structure comprised of a top ring, a bottom ring, and frame members propped between the top ring and the bottom ring. The bottom ring has aligned with the top ring support rod positions and extending from the center to its circumference slide rods and, furthermore, coupling rings capable of traveling back and forth along the slide rods are ensleeved onto the slide rods. Each coupling ring has projecting upward a hinge tab with a through-hole formed in it, the bottom ends of the paired brace rods of the frame members are punched into a flat shape and, furthermore, the fastening sections have an insertion hole formed in the center, thereby providing for riveted conjoinment of the frame member fastening sections to the coupling ring hinge tabs. Capable of traveling reciprocally along the slide rods, the coupling rings maintain the top ring and the bottom ring in a reinforced open state or are folded down such that the top and bottom rings are brought against each other in a closed state. As such, the invention herein achieves rapid assembly and disassembly and, furthermore, a reduction in material storage area that effectively lowers shipping costs.

4 Claims, 7 Drawing Sheets

FIG2-A

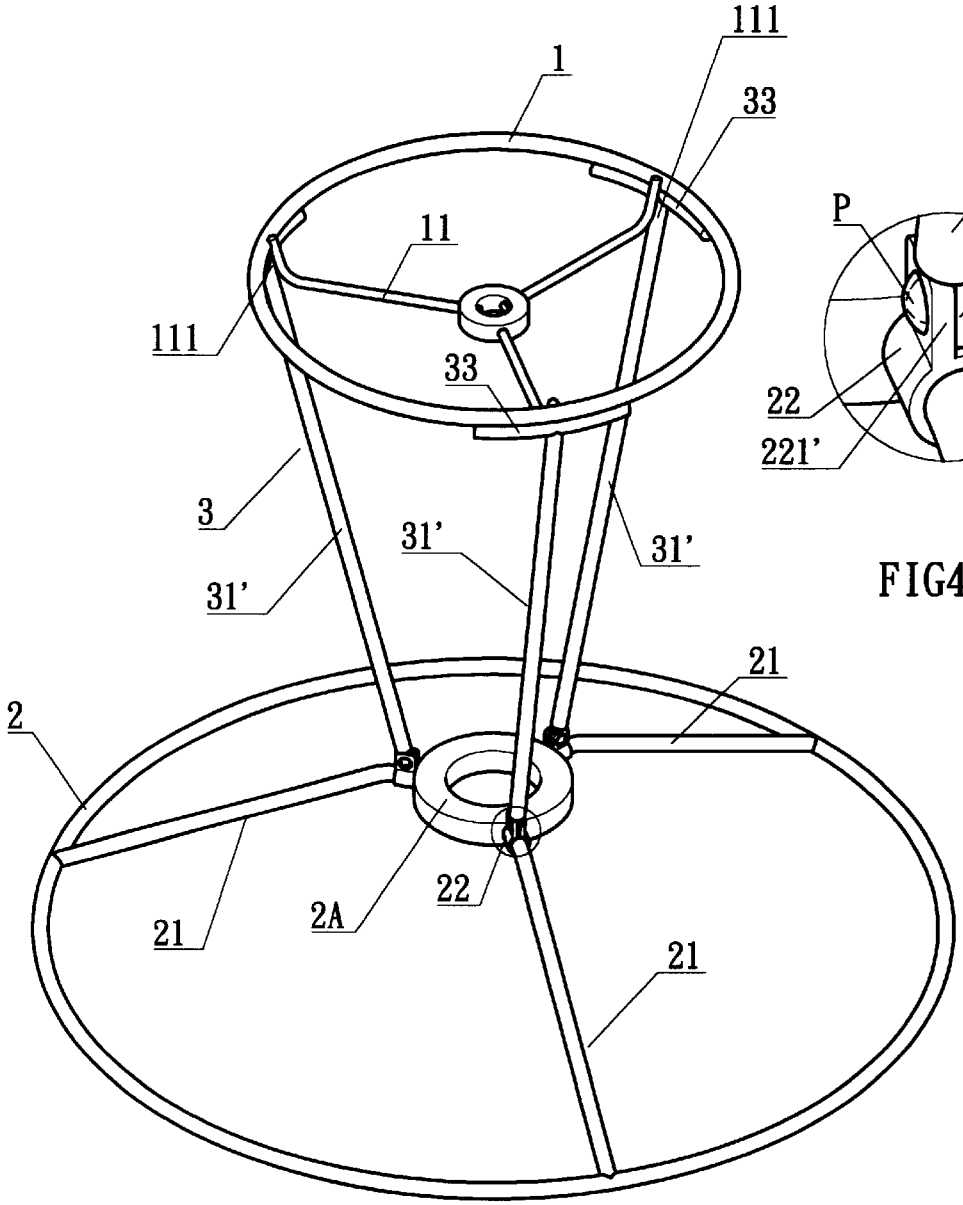
FIG4
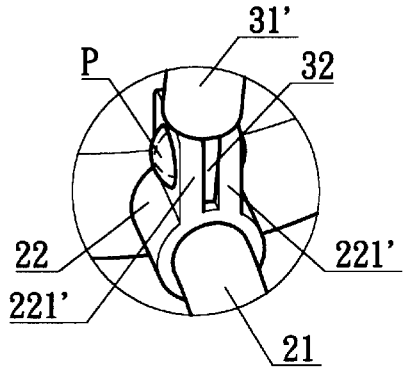
FIG4-A

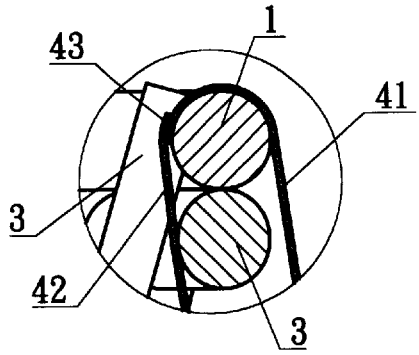
FIG5-A
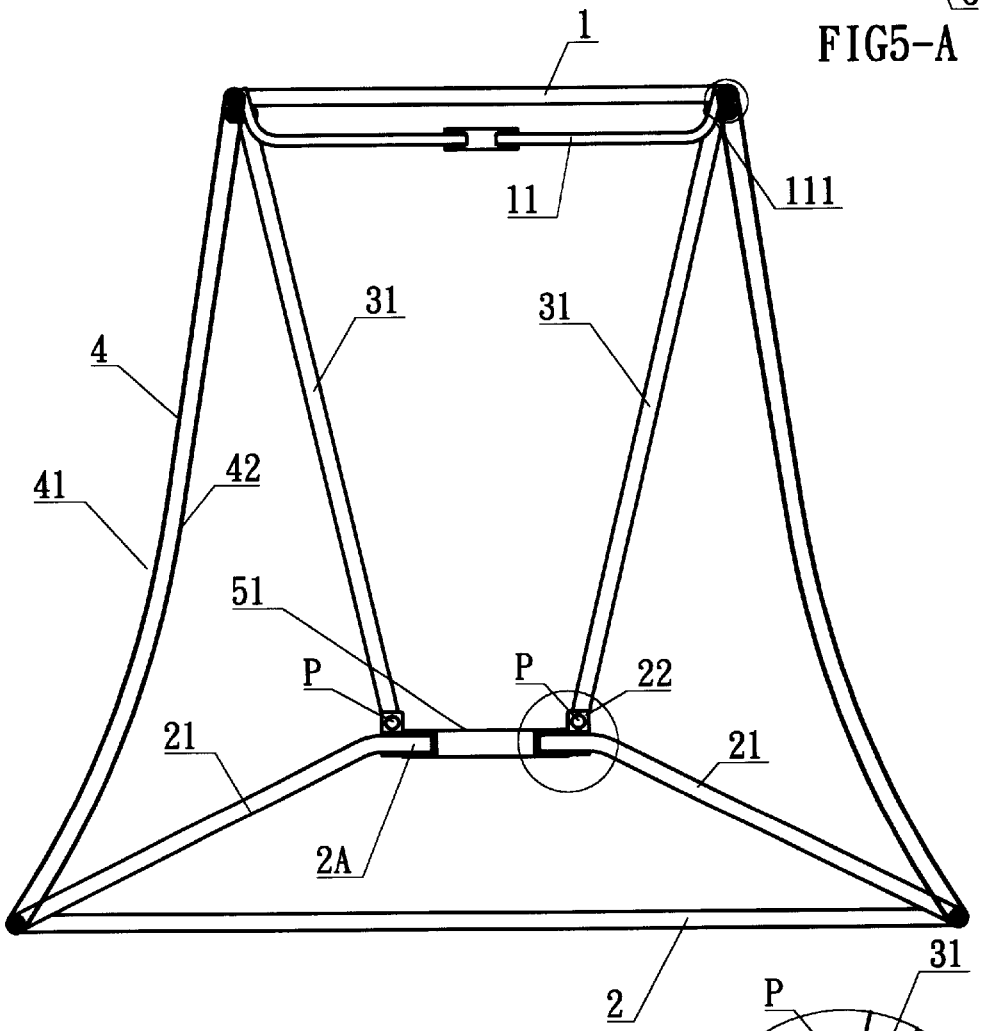
FIG5
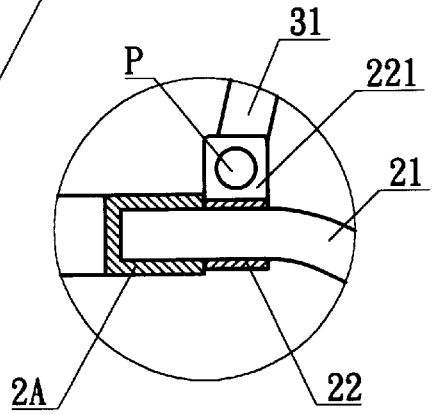
FIG5-B

RAPID ASSEMBLY AND DISASSEMBLY LAMP SHADE STRUCTURE

BACKGROUND OF THE INVENTION

1) Field of the Invention

The invention herein relates to a rapid assembly and disassembly lamp shade structure in which a bottom ring has extending consecutively from the center to its circumference slide rods and, furthermore, the slide rods have disposed on them coupling rings capable of traveling back and forth, and the bottom ends of the frame member brace rods are punched into fastening sections, the structural features providing for the riveted conjoinment of the frame member fastening sections to coupling ring hinge tabs; capable of traveling reciprocally along the slide rods, the coupling rings maintain the top ring and the bottom ring in a reinforced open state or are folded down such that the top and bottom rings are brought against each other into an closed state, as such, the invention herein achieves rapid assembly and disassembly and, furthermore, a reduction in material storage area that effectively lowers shipping costs.

2) Description of the Prior Art

A conventional lamp shade 6, referring to FIG. 7, typically has its frame member permanently fixed between the top ring and the bottom ring to form a lamp shade structure; however, such structures are imperfect in that since the conventional lamp shade 6 is a structural entity of an unyielding shape, when it is packaged in a carton, the lamp shade 6 cannot be forcefully diminished in size and no reduction in large volume storage area is possible, which leads to a proportional increase in product shipping costs and results in greater overhead.

SUMMARY OF THE INVENTION

The primary objective of the invention herein is to provide a rapid assembly and disassembly lamp shade structure comprised of a top ring, a bottom ring, and frame members propped between the top ring and the bottom ring; the said bottom ring has aligned with the top ring support rod positions and extending from the center to its circumference slide rods and, furthermore, coupling rings capable of traveling back and forth along the slide rods are ensleeved onto the slide rods; each coupling ring has projecting upward a hinge tab with a through-hole formed in it, the bottom ends of the paired brace rods of the frame members are punched into a flat shape and, furthermore, the fastening sections have an insertion hole formed in the center, thereby providing for riveted conjoinment of the frame member fastening sections to the coupling ring hinge tabs; capable of traveling reciprocally along the slide rods, the coupling rings maintain the top ring and the bottom ring in a reinforced open state or are folded down such that the top and bottom rings are brought against each other into a closed state; as such, the invention herein achieves rapid assembly and disassembly and, furthermore, a reduction in material storage area that effectively lowers shipping costs.

BRIEF DESCRIPTION OF THE DRAWINGS

FIG. 2A is a magnified view of the conjoinment position.

FIG. 4 is an isometric drawing of the second embodiment of the invention herein.

FIG. 4-A is a magnified view of the conjoinment position.

FIG. 5 is a cross-sectional drawing of the lamp shade of the invention herein.

FIG. 5-A is a magnified view of the lamp shade adhesive position.

FIG. 5-B is a magnified view of the conjoinment position.

DETAILED DESCRIPTION OF THE INVENTION

Figure 1:
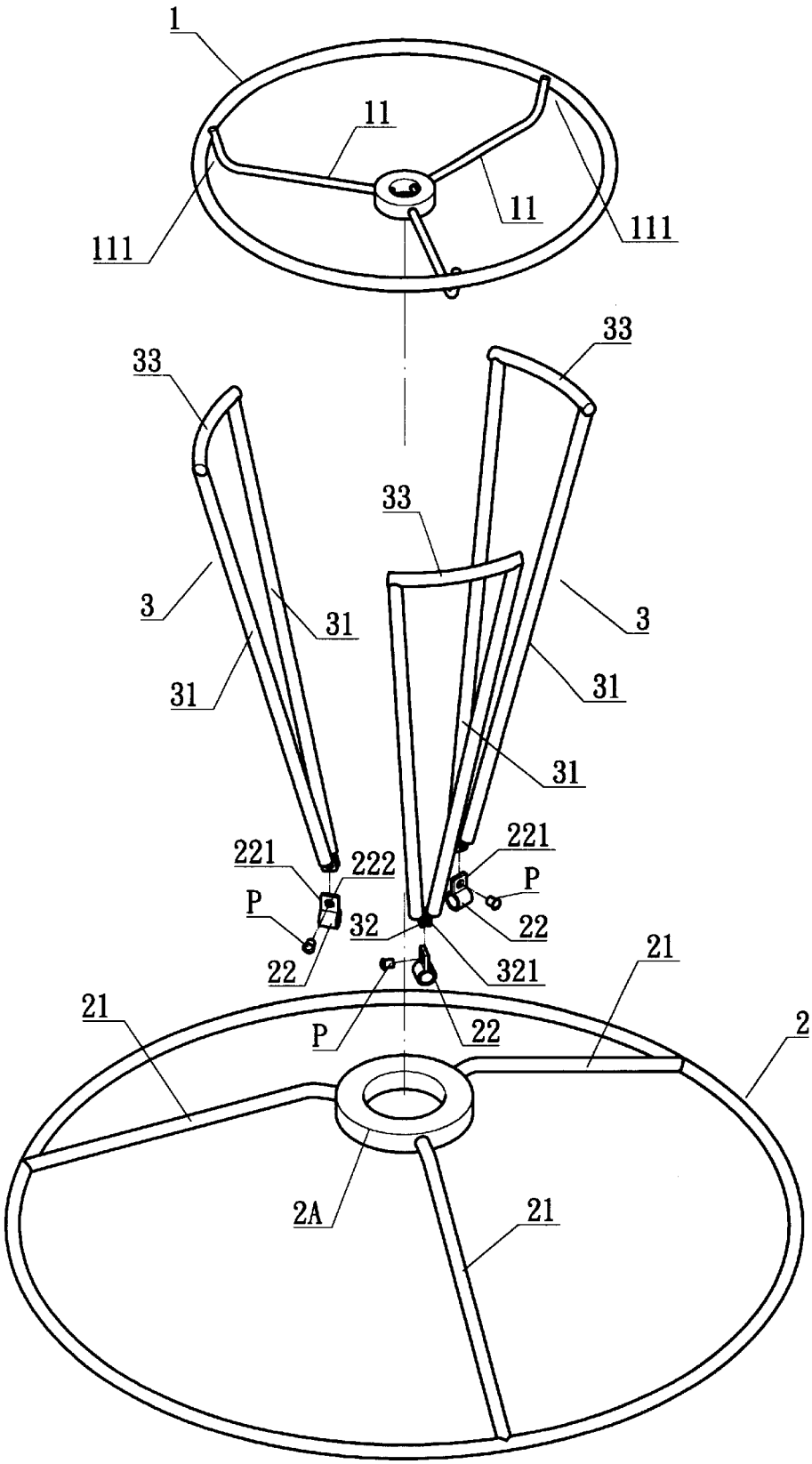
FIG. 1 is an exploded drawing of the invention herein.
Figure 2:
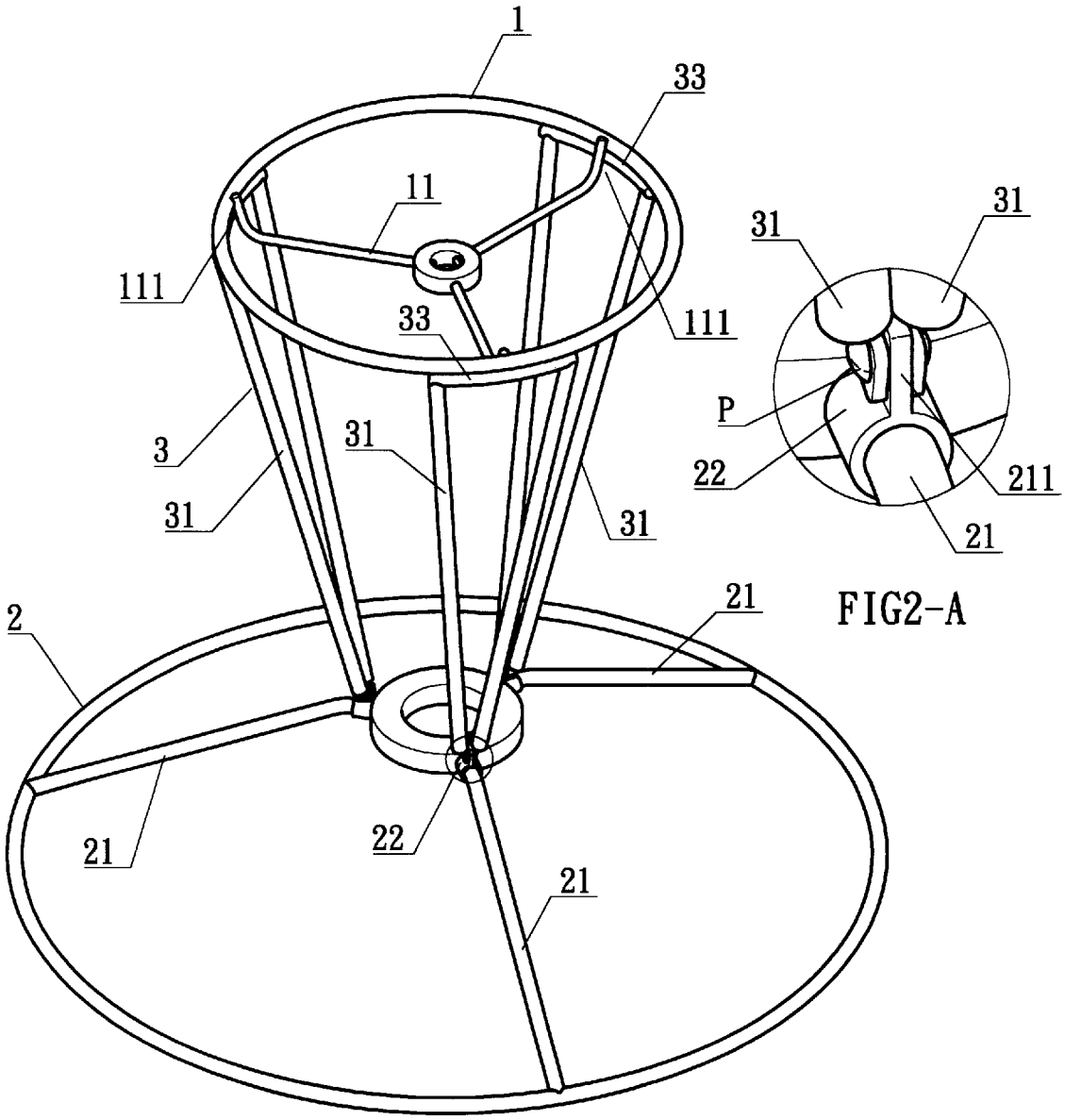
FIG. 2 is an isometric drawing of the invention herein.

Referring to FIG. 1 and FIG. 2, the structural arrangement of the present invention, the invention herein is comprised of a top ring 1 at the uppermost end of the lamp shade, a bottom ring 2 of larger circumference than the top ring 1, and frame members 3 propped between the top ring 1 and the bottom ring 2, of which:

The said top ring 1 has support rods 11 extending from the center to the circumference and, furthermore, the support rods 11 are aligned with the frame members 3 at the circumferential edge of the top ring 1 and an inclosing space 111 is formed by upward bending that provides for situating the top ends of the frame members 3 against the bottom edge of the inclosing space 111.

The said bottom ring 2 has aligned with the top ring 1 support rod 11 positions and extending from the center to its circumference slide rods 21 and, furthermore, before the slide rods 21 are installed, coupling rings 22 capable of traveling back and forth are first sleeved onto their rod bodies; each coupling ring 22 has projecting upward a hinge tab 221 and, furthermore, a through-hole 222 is formed in each hinge tab 221 to provide for conjoinment to the frame member 3 fastening sections 32.

The said frame members 3 have their top ends against the bottom edge of the inclosing spaces 111, each said frame member 3 consisting of a pair of brace rods 31, the separation of which is gradually reduced from a top rod 33 such that the bottom ends merge and become flush, with the bottom ends of the rod bodies continuously punch molded into flat-shaped fastening sections 32 and, furthermore, an insertion hole 321 is formed in the center of the fastening sections 32; each fastening section 32 is aligned with a coupling ring 22 hinge tab 22 and a rivet P is inserted into each through-hole 22 and insertion hole 321 to conjoin the frame members 3 to the bottom ring 2.

Figure 3:
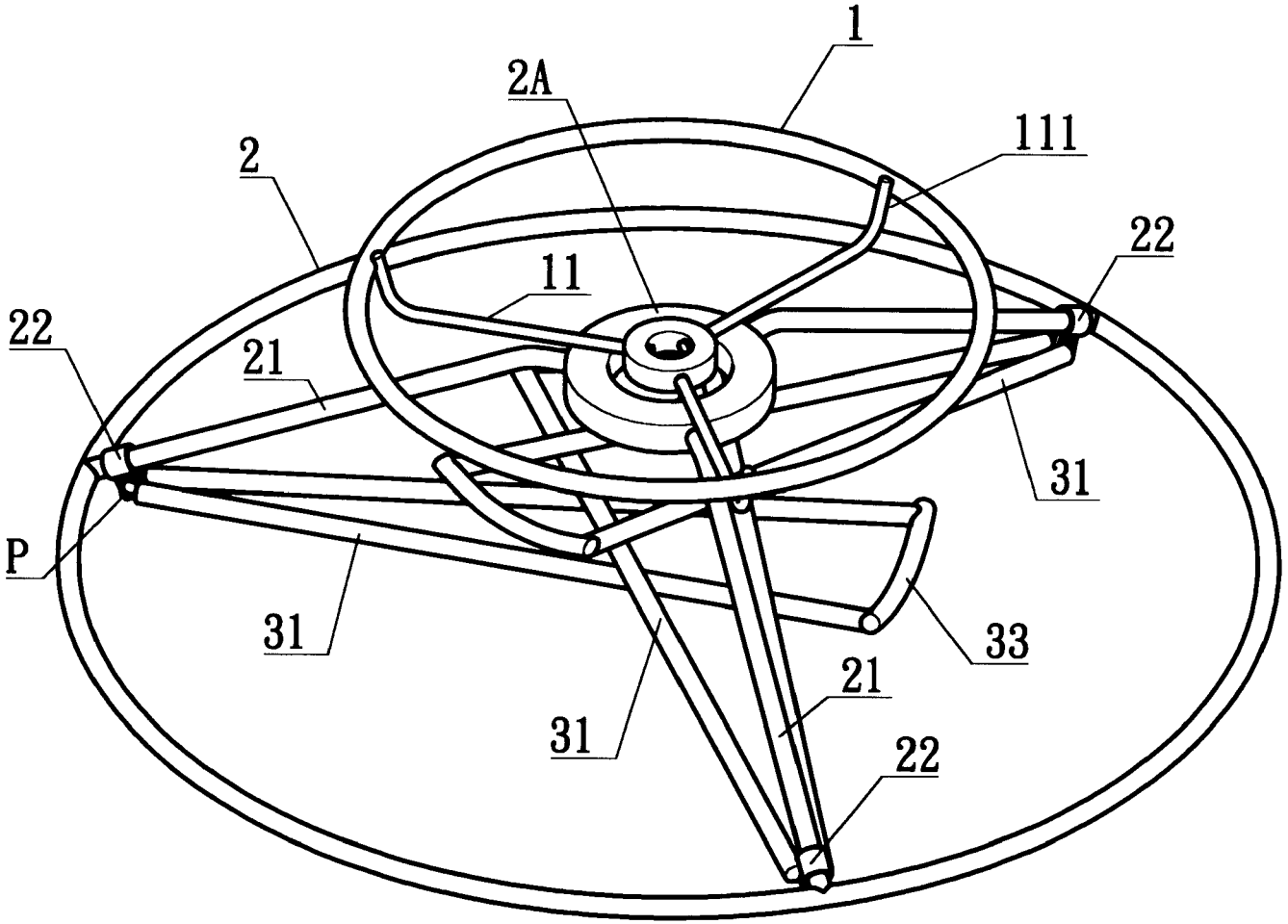
FIG. 3 is an isometric drawing of the invention herein when folded.

Referring to FIG. 2 and FIG. 3, the coupling rings 22 are first sleeved onto the slide rods 21 of the bottom ring 2; of the frame member 3 brace rod 31 pairs that are gradually reduced in separation from the top rod 33 until the bottom ends become flush, the bottom ends are punched into flat-shaped fastening sections 32; furthermore, the fastening sections 32 at the bottom section of the frame members 3 are aligned with the coupling ring 22 hinge tabs 22 and conjoined by the rivet P to provide for an appropriate turning angle of the frame members 3 on the coupling rings 22 and, furthermore, the coupling rings 22 capable of traveling reciprocally along the slide rods 21; when the coupling rings 22 are situated against the center portion of the bottom ring 2, the bottom ring 2 and the top ring 1 are maintained at a maximum distance apart and the frame members 3 are engaged into position between the top ring 1 and the bottom ring 2, thereby resulting a reinforced open state (as shown in FIG. 2); when folding is desired, the coupling rings 22 are moved towards the outer side of the bottom ring 2 such that the frame members 3 are released from engagement with the top ring 1, thereby providing for folding the top ring 1 down against the bottom ring 2 into a closed state (as shown in FIG. 3) and, as such, when packaged in cartons, the lamp shade of the present invention occupies the smallest physical assembly space to facilitate ease of assembly and disassembly and, furthermore, the resulting minimized storage area effectively reduces shipping costs.

Referring to FIG. 4, the drawing of another embodiment of the invention herein, the said frame members 3 have their top ends situated against the bottom edge of the inclosing space 111, each said frame member 3 consisting of a single brace rod 31' extending downward from the center of the top rod 33 and the bottom ends are continuously punch molded into flat-shaped fastening sections 32, with an insertion hole 321 is formed in the center of the fastening sections 32; the coupling rings 22 are sleeved onto the slide rods 21 of the bottom ring 2, each coupling ring 22 has projecting upward two hinge tabs 221' in a parallel arrangement and, furthermore, a through-hole 222 is formed in both of the two hinge tabs 221' to provide for aligning the frame member 3 fastening sections 32 between the two hinge tabs 221" and a rivet P is inserted into each through-hole 222 and insertion hole 321 to conjoin the frame members 3 to the bottom ring 2; since the coupling rings 22 are capable of traveling back and forth on the slide rods 21, the top ring 1 can be folded down against the bottom ring 2 into a closed state.

Referring to FIG. 5, after the assembly of the said lamp shade framework is completed, the exterior periphery of the top ring 1 and the bottom ring 2 are covered with a fabric material lamp shade 4, wherein the exterior fabric surface layer 41 of the said lamp shade 4 is first tightly fitted onto the outer periphery of the frame members 3; the interior fabric surface layer 42 is then placed along the inner sides of the frame members 3 and, furthermore, an adhesive fastening tape 43 is respectively applied over the appropriate portions of the interior and the exterior fabric surface layers 41 and 42, the frame members 3 are enveloped within such that the frame members 3 remain unexposed due to the ensconcing structural arrangement constituted by the interior and the exterior fabric surface layers 41 and 42, while also effectively achieving an attractive appearance; in addition, when the framework is folded, the lamp shade 4 collapses along with it to achieve a reduction in material storage area and thereby effectively lowers shipping costs.

Figure 6:
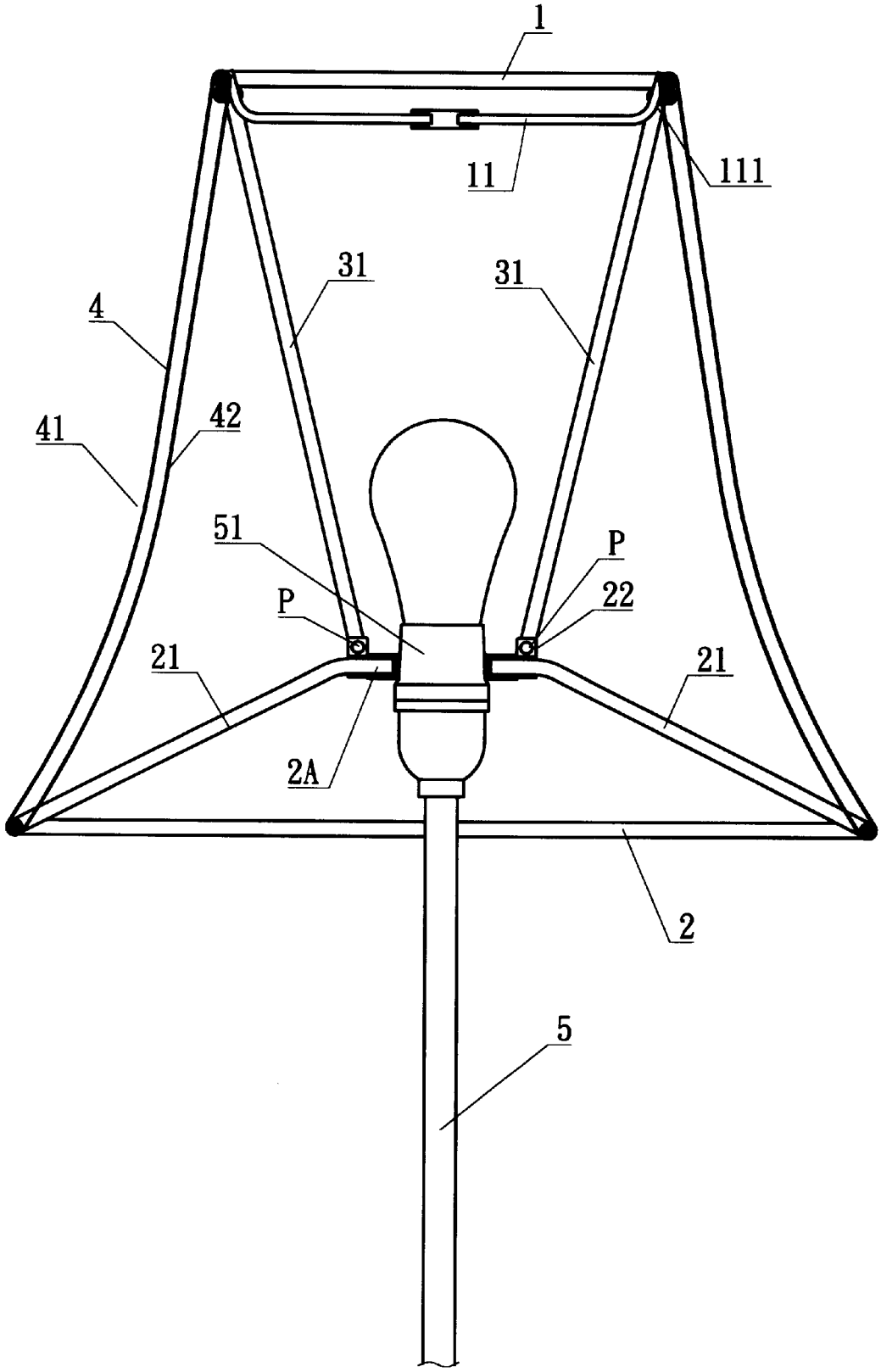
FIG. 6 is a cross-sectional drawing of the invention herein as installed on the lamp pipe.
Figure 7:
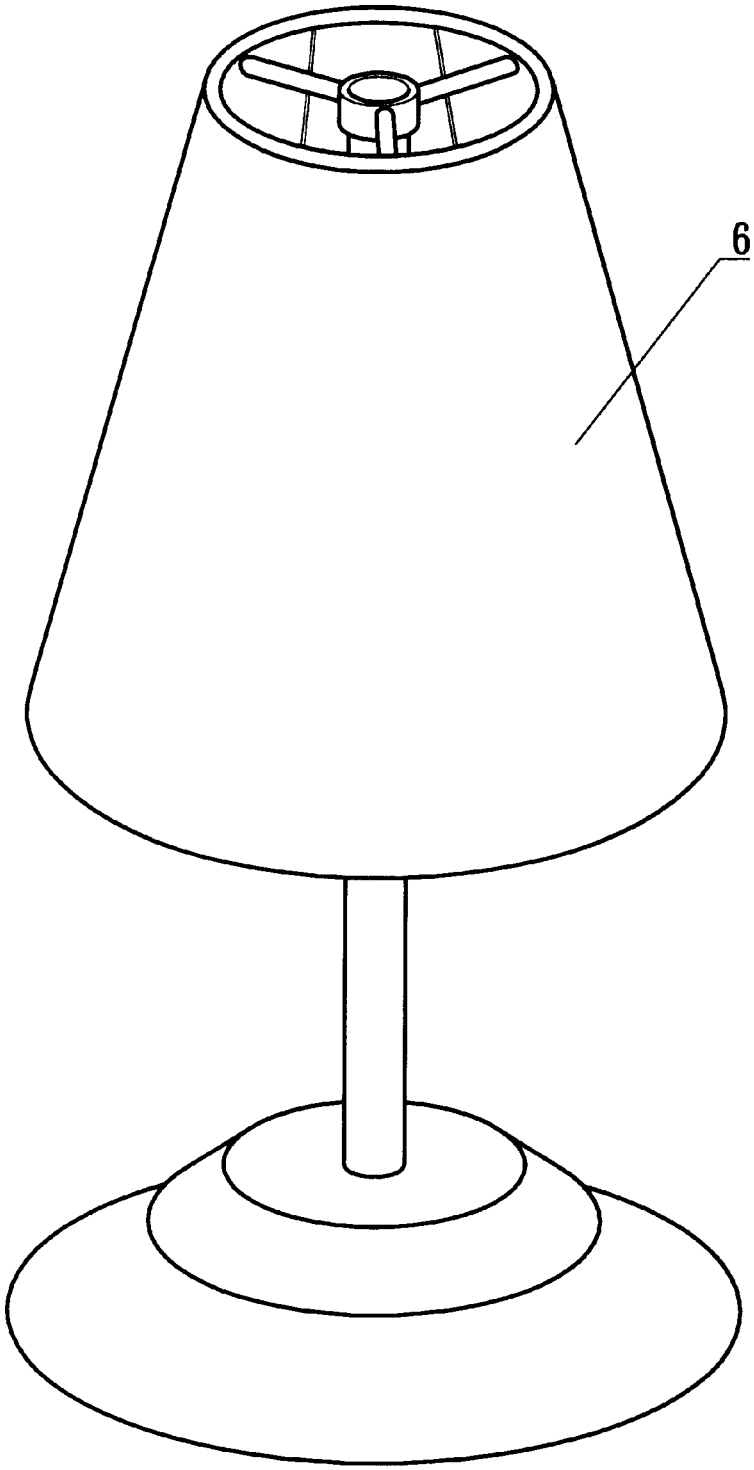
FIG7 PRIOR ART
FIG. 7 is an isometric drawing of a conventional lamp shade.

Referring to FIG. 6, the drawing of the invention herein as installed on the lamp pipe 5, the said lamp pipe 5 has at its top end an terminal fixture 51 of a stepped arrangement and, furthermore, the said terminal fixture 51 is secured in the middle ring 2A at the center of the bottom ring 2 to support the lamp shade 4.

What is claimed is:

1. A rapid assembly and disassembly lamp shade structure comprised of a top ring, a bottom ring at the lowest aspect of a lamp shade, and frame members propped between the said top ring and the said bottom ring, wherein the said top ring has support rods extending from the center to the circumference and, furthermore, the said support rods are aligned with the said frame members at the circumferential edge of the said top ring and an inclosing space is formed by upward bending that provides for situating the top ends of the said frame members against the said inclosing spaces; the said bottom ring has aligned with the said top ring support rod positions and extending from the center to its circumference slide rods and, furthermore, coupling rings are ensleeved onto the said slide rods, with the said coupling rings capable of traveling back and forth along the said slide rods; each said frame member consists of a pair of brace rods, the separation of which is gradually reduced from a top rod such that the bottom ends merge and become flush, the bottom ends are punched into flat-shaped fastening sections and each said fastening section is aligned with one said coupling ring for conjoinment into a unitary structural entity; as such, ease of assembly is achieved and, furthermore, the resulting minimized storage area effectively reduces shipping costs.

2. As mentioned in claim 1 of the rapid assembly and disassembly lamp shade structure of the invention herein, the said support members have an insertion hole formed in the center of their said fastening sections; the said coupling rings are sleeved onto the said slide rods of the said bottom ring and, furthermore, the said coupling rings are capable of traveling back and forth on the said slide rods; each said coupling ring has projecting upward a hinge tab and, furthermore, a through-hole is formed in each said hinge tab to provide for the alignment of the said frame member fastening sections with the said coupling ring hinge tabs, and a rivet is inserted into each said through-hole and said insertion hole to conjoin the said frame members to the said bottom ring.

3. As mentioned in claim 1 of the rapid assembly and disassembly lamp shade structure of the invention herein, each said frame member consists of a single brace rod extending downward from the center of the said top rod, the bottom ends of which are punched into flat-shaped said fastening sections and, furthermore, the said fastening sections have an insertion hole formed in them; of the said coupling rings sleeved onto the said slide rods of the said bottom ring, each said coupling ring has projecting upward two hinge tabs in a parallel arrangement and, furthermore, the said hinge tabs have a through-hole formed in them to provide for aligning the said frame member fastening sections between the said two hinge tabs and a rivet is inserted for conjoinment.

4. As mentioned in claim 1 of the rapid assembly and disassembly lamp shade structure of the invention herein, the exterior periphery of the said top ring and the said bottom ring are covered with a fabric material lamp shade; the exterior fabric surface layer of the said lamp shade is first tightly fitted onto the outer periphery of the said frame members, the interior fabric surface layer is then placed along the inner sides of the said frame members and, furthermore, an adhesive fastening tape is respectively applied over the appropriate portions of the said interior and the exterior fabric surface layers and, the said interior and exterior fabric surface layers thereby constituting an ensconcing structural arrangement that effectively achieves an attractive appearance; in addition, when the framework is folded, the said lamp shade collapses along with it to achieve a reduction in material storage area and thereby effectively lowers shipping costs.

* * * * *